US012420324B1

(12) United States Patent
Yu et al.

(10) Patent No.: US 12,420,324 B1
(45) Date of Patent: Sep. 23, 2025

(54) HELICAL FRICTION EXTRUSION MACHINE AND EXTRUSION FORMING METHOD

(71) Applicant: SHANDONG UNIVERSITY, Jinan (CN)

(72) Inventors: Junquan Yu, Jinan (CN); Guoqun Zhao, Jinan (CN)

(73) Assignee: SHANDONG UNIVERSITY, Jinan (CN)

( * ) Notice: Subject to any disclaimer, the term of this patent is extended or adjusted under 35 U.S.C. 154(b) by 0 days.

(21) Appl. No.: 19/250,302

(22) Filed: Jun. 26, 2025

(30) Foreign Application Priority Data

Jul. 9, 2024 (CN) ..... 202410916354.4

(51) Int. Cl.
*B21C 23/21* (2006.01)
*B21C 23/32* (2006.01)
*B21C 25/02* (2006.01)

(52) U.S. Cl.
CPC ..... *B21C 23/212* (2013.01); *B21C 23/211* (2013.01); *B21C 23/32* (2013.01); *B21C 25/02* (2013.01)

(58) Field of Classification Search
CPC ..... B21C 23/211; B21C 23/212; B21C 23/32; B21C 25/02
See application file for complete search history.

(56) References Cited

U.S. PATENT DOCUMENTS 2,447,129 A * 8/1948 Lorant ..... B30B 11/265 425/380
2,933,184 A * 4/1960 Billen ..... B21C 23/211 72/271
2014/0102159 A1* 4/2014 Denison ..... B21C 23/085 72/253.1

(Continued)

FOREIGN PATENT DOCUMENTS

CN 101264573 A 9/2008
CN 102303062 A * 1/2012

(Continued)

OTHER PUBLICATIONS

Wang, Guohong, "Mandrel control of mandrel restraining for metal extrusion press", China Metal Forming Equipment Manufacturing Technology, 06, Dec. 31, 2013.

*Primary Examiner* — Jared O Brown
(74) *Attorney, Agent, or Firm* — IPro, PLLC; Na Xu

(57) ABSTRACT

A helical friction extrusion machine comprises a first fixed beam and a second fixed beam being arranged fixedly, a moving beam fixed to an extrusion container and an outer sliding block fixed to a forward extrusion rod that is located between the moving beam and the outer sliding block, a first main cylinder and a second main cylinder connecting to outer sliding block to drive the outer sliding block to move being fixed to second fixed beam, a perforating cylinder located on a central axis and connected to a central sliding block being further fixed to second fixed beam, a rotating platform which a rotating extrusion rod being fixed to and (Continued)

driven by a driving device to rotate being mounted on first fixed beam, a perforating needle being connected to perforating cylinder and fixed to male die, female die being fixed to the rotating extrusion rod, and a hopper being located above the extrusion container.

10 Claims, 4 Drawing Sheets

(56) References Cited

U.S. PATENT DOCUMENTS

2022/0203419 A1* 6/2022 Stewart ..... B21C 23/085

FOREIGN PATENT DOCUMENTS

| | | | |
|---|---|---|---|
| CN | 206643145 | U | 11/2017 |
| CN | 109570253 | A | 4/2019 |
| JP | 2003001320 | A | 1/2003 |
| JP | 2015100830 | A | 6/2015 |
| WO | 9513150 | A1 | 5/1995 |
| WO | 2009008819 | A1 | 1/2009 |

* cited by examiner

HELICAL FRICTION EXTRUSION MACHINE AND EXTRUSION FORMING METHOD

CROSS-REFERENCE TO RELATED APPLICATIONS

The present disclosure claims priority to Chinese Patent Application No. 202410916354.4, entitled "Helical Friction Extrusion Machine and Extrusion Forming Method", filed to the China National Intellectual Property Administration on Jul. 9, 2024. The entire content of the application is incorporated herein by reference and constitute part of the present disclosure for all purposes.

TECHNICAL FIELD

The present disclosure relates to the field of high-performance and low-energy-consumption forming manufacturing of metal and composite materials, in particular to a helical friction extrusion machine and an extrusion forming method.

BACKGROUND

Extruded materials of high-performance lightweight alloys and composite materials thereof are key parts for achieving the light weight of aerospace aircrafts and ground and marine transport apparatuses. However, at present, there are prominent problems of high production energy consumption, long process flow, degraded product quality and severe anisotropy in extrusion forming production and recycling. Therefore, it is urgent to develop a new extrusion forming process and a special apparatus.

SUMMARY

For the limitations of existing extrusion forming technologies and apparatuses, the present disclosure aims to provide a helical friction extrusion machine and an extrusion forming method, which are used to achieve the low-energy-consumption, short-flow, high-quality and weak-anisotropy extrusion forming manufacturing and recycling of extruded materials of high-performance lightweight alloys and composite materials thereof.

To achieve the above purpose, the present disclosure provides a helical friction extrusion machine and an extrusion forming method.

In a first aspect, the present disclosure provides a helical friction extrusion machine, including a main machine and a tool die, where the main machine includes a first fixed beam, a moving beam, an outer sliding block, a second fixed beam, guide columns, a first main cylinder, a perforating cylinder, a second main cylinder, a rotating platform, and a central sliding block; the first fixed beam and the second fixed beam are respectively located at two ends of the extrusion machine and are fixed in position; the moving beam and the outer sliding block are located between the first fixed beam and the second fixed beam and performs reciprocating rectilinear motion during operation of the extrusion machine; the moving beam is arranged close to the first fixed beam, and the outer sliding block is arranged close to the second fixed beam; the guide columns pass through the first fixed beam, the moving beam, the outer sliding block, and the second fixed beam; the first main cylinder, the perforating cylinder and the second main cylinder are fixed to the second fixed beam, the perforating cylinder is located on a central axis, and the first main cylinder and the second main cylinder are respectively located on two sides of the perforating cylinder and are connected to the outer sliding block to drive the outer sliding block to move; the central sliding block is connected to the perforating cylinder; the rotating platform is fixed to the first fixed beam, the central position of the rotating platform is located on the central axis of an apparatus, and a through hole is formed inside the rotating platform for discharging;

the tool die includes a rotating extrusion rod, an extrusion container, a forward extrusion rod, a hopper, a female die, a male die, and a perforating needle; the rotating extrusion rod is fixed to the rotating platform; the extrusion container is fixed to the moving beam; the forward extrusion rod is fixed to the outer sliding block; the hopper is located above the extrusion container and close to one side of the outer sliding block; the perforating needle is connected to the perforating cylinder; the female die is fixed to the rotating extrusion rod; and the male die is fixed to the perforating needle.

As a further technical solution, the helical friction extrusion machine further includes a motion driving system, which includes a rotating platform driving device, a driving device for the first main cylinder, the perforating cylinder and the second main cylinder, and a motion control platform; and the rotating platform driving device and the driving device for the first main cylinder, the perforating cylinder and the second main cylinder are connected to the motion control platform.

As a further technical solution, the helical friction extrusion machine further includes a circulating temperature control system, which includes a temperature measurement sensor, a heating element, a cooling element, and a temperature control platform; the temperature measurement sensor is further arranged in the rotating extrusion rod and the female die, the temperature measurement sensor is connected to a wireless transmitter, and temperature measurement data are transmitted to the temperature control platform in a wireless transmission form; the heating element and the cooling element are further arranged in the extrusion container for heating the extrusion container; and the temperature measurement sensor, the heating element and the cooling element are connected to a control platform.

As a further technical solution, the circulating temperature control system further includes an oil cooler, and the oil cooler is configured to cool a bearing of the rotating platform and a speed reducer.

As a further technical solution, the helical friction extrusion machine further includes a control system, which includes a forward extrusion rod control module, a perforating needle control module, an extrusion container control module, a rotating extrusion rod control module, a heating element control module, a cooling element control module, and corresponding real-time display systems.

As a further technical solution, the hopper is further arranged on the extrusion container.

In a second aspect, the present disclosure further provides a forming method using the helical friction extrusion machine, the method including:

Step 1: placing a raw material into an extrusion container.

As a further technical solution, a cylindrical blank is directly placed into the extrusion container from an inlet of the extrusion container.

As a further technical solution, for the raw material such as machining chips, metal powder and a mixture, the raw material is first weighed and then is placed into the extrusion container from the hopper in batches, the moving beam is moved to compress the raw material such as the chips, the powder and the mixture under the pressure of the forward extrusion rod, the density is calculated each time of compression according to the weight of the raw material and the compressed volume, and the density is controlled to be 50% of the density of the raw material such as the chips, the powder and the mixture or higher.

Step 2: enabling the rotating extrusion rod to rotate with a rotating speed controlled within 0.5-3000 r/min.

Step 3: enabling the forward extrusion rod and the extrusion container to get close to the rotating extrusion rod synchronously to achieve helical friction extrusion forming.

As a further technical solution, in the whole extrusion process, an extrusion speed is controlled with a strategy of slow first and then fast, followed by dynamic adjustment; that is, the material in the extrusion container first slowly gets close to the rotating extrusion rod which is rotating, after the material starts to be heated and softened under the friction action of the rotating extrusion rod, the extrusion speed is increased, and the extrusion speed is dynamically adjusted according to actual requirements; in the whole extrusion process, the extrusion speeds of the forward extrusion rod and the extrusion container are controlled within 0.01-50 mm/s.

As a further technical solution, in the whole extrusion process, the temperature near a working land of the die is monitored by means of the temperature measurement sensor, and the extrusion speed as well as heating and cooling of the extrusion container is adjusted dynamically to control the temperature to be 90% of the melting point of the material or below or below −100° C.

Step 4: enabling the material to perform helical motion in a gap between the male die and the female die, and form an extruded material after flowing out of a die port.

As a further technical solution, during design of the extrusion container and an extrusion die, the ratio of the cross-sectional area of the extrusion container to the cross-sectional area of the extruded material is controlled to be 1-200.

The present disclosure has the following beneficial effects:

1. The material of the present disclosure performs the helical motion in the gap between the male die and the female die or the working land of the female die, so that the texture type of an extruded profile can be controlled by controlling the extrusion speed, the extrusion ratio and the rotating speed, the flow line of the material is a helical flow line which is different from a straight flow line in a traditional extruded profile, and it helps to eliminate the anisotropy.

2. The material of the present disclosure undergoes severe shear deformation in the whole forming process, which is beneficial to grain refinement (even formation of nanoscale twins), chips consolidation, oxide breakage, and interface bonding, so that the performance of the extruded material is greatly improved, and the profile obtained through chips forming can be used without downgrading.

3. The helical friction extrusion machine of the special design in the present disclosure solves the problems about loading, feeding, compressing, and perforating, and the apparatus is suitable for industrial large-scale production; and the apparatus can be used for forming and preparing various profiles with solid or hollow sections and unlimited length directions, such as bars, wires, pipes and complex profiles.

4. The raw material in the present disclosure does not need to be heated, the heating element is arranged in the extrusion container, the procedure of heating a bar in a traditional hot extrusion process is cancelled, the energy generated under the friction action in the extrusion process is fully utilized, and the energy consumption is effectively reduced.

Figure 1:
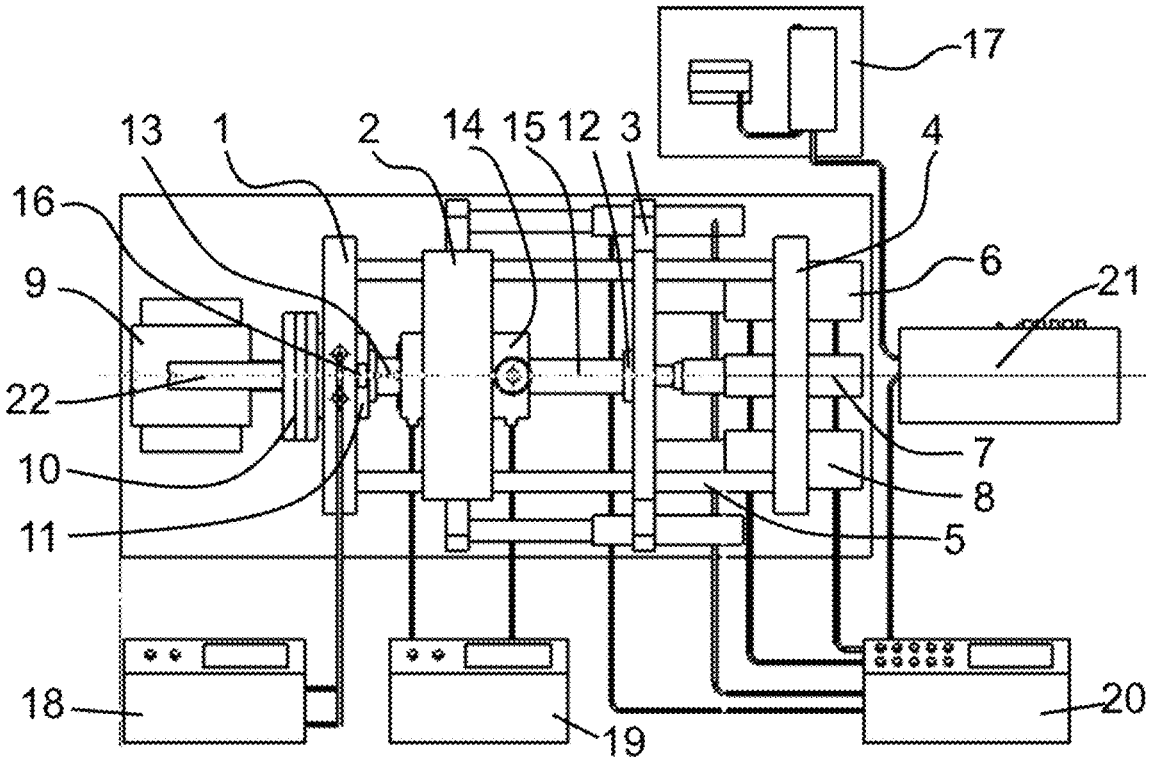
FIG. 1 is a top view of a structural schematic diagram of a helical friction extrusion machine.

In the figures, 1—first fixed beam, 2—moving beam, 3—outer sliding block, 4—second fixed beam, 5—guide column, 6—first main cylinder, 7—perforating cylinder, 8—second main cylinder, 9—motor, 10—speed reducer, 11—rotating platform, 12—central sliding block, 13—rotating extrusion rod, 14—extrusion container, 15—forward extrusion rod, 16—wireless transmitter, 17—control platform, 18—oil cooler, 19—heating and cooling control system, 20—hydraulic power unit, 21—electrical control cabinet, and 22—extruded material;

23—temperature measurement sensor, 24—heating element, 25—hopper, 26—blank, 27—female die, 28—male die, 29—perforating needle;

30—raw materials such as machining chips, metal powder and a mixture; 31—compressed blank; 32—stacked compressed blank; and 33—regenerative extruded material.

DETAILED DESCRIPTION

It should be pointed out that the detailed descriptions below are illustrative and are intended to further explain the present disclosure. Unless otherwise indicated, all technical and scientific terms used herein have the same meanings as those generally understood by those of ordinary skill in the art of the present disclosure.

It should be noted that the terms used here are only for the purpose of describing the specific embodiments, and are not intended to limit the exemplary embodiments according to the present disclosure. As used here, unless otherwise explicitly indicated in the present disclosure, the singular forms are also intended to include the plural forms. Besides, it should be understood that when the terms "comprising" and/or "including" are used in the present description, the terms indicate the existence of features, steps, operations, devices, assemblies and/or combinations thereof.

To facilitate the description, if the words "upper", "lower", "left" and "right" appear in the present disclosure, the words only indicate the consistency with the upper, lower, left and right directions in the drawings, do not limit the structures, and are only for the purposes of facilitating the description of the present disclosure and simplifying the description rather than indicating or implying that the referenced apparatus or element must have a particular orientation or be constructed and operated in a particular orientation, and thus are not to be construed as limitations on the present disclosure.

As introduced in the background, the prior art has defects. To solve the above technical problems, the present disclosure provides a helical friction extrusion machine and an extrusion forming method.

Figure 2:
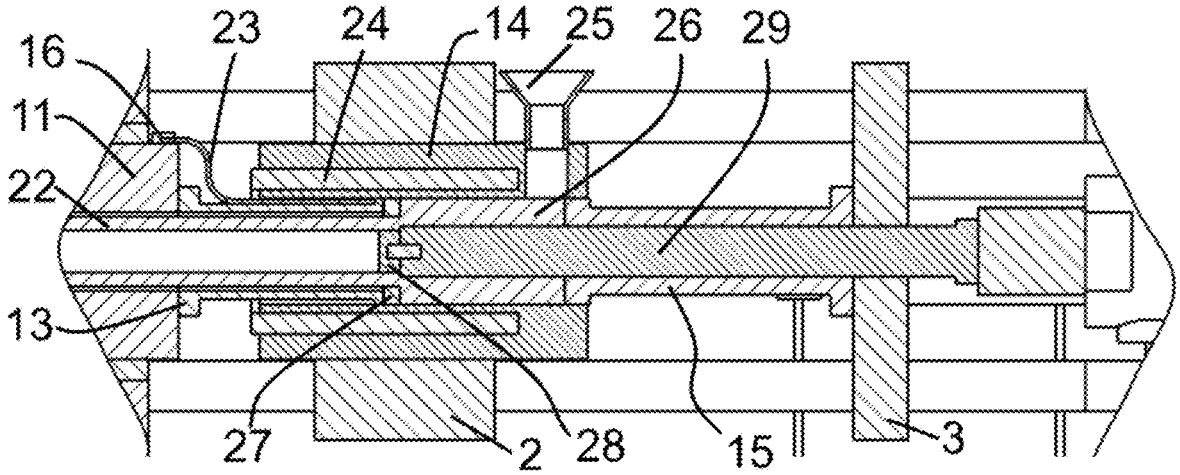
FIG. 2 is a local sectional view of the helical friction extrusion machine.
Figure 3:
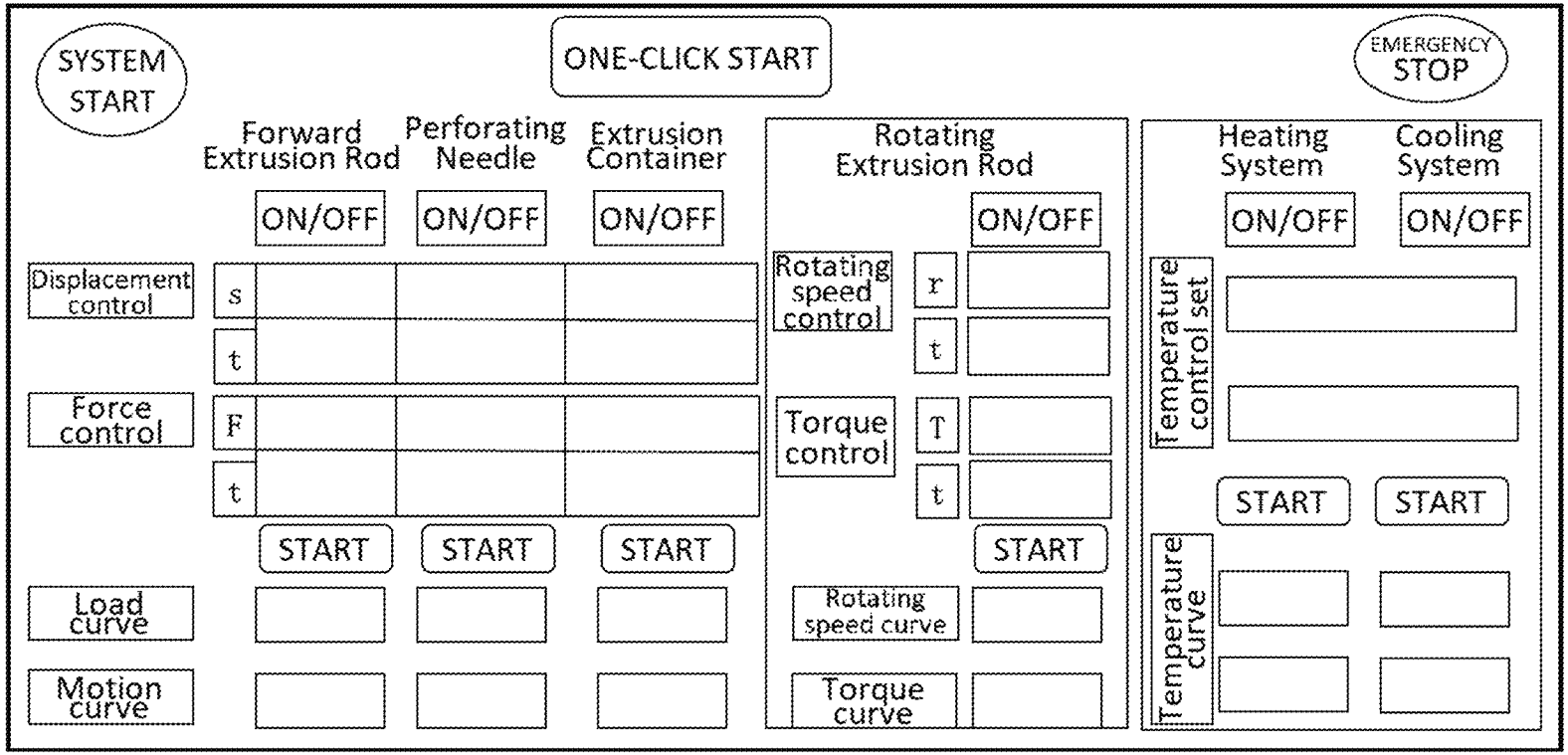
FIG. 3 is a schematic diagram of a control interface of the helical friction extrusion machine.

As shown in FIGS. 1 and 2, the present example discloses a helical friction extrusion machine, mainly including a main machine, a tool die, a motion driving system, and a circulating temperature control system.

The main machine mainly includes a first fixed beam 1, a moving beam 2, an outer sliding block 3, a second fixed beam 4, guide columns 5, a first main cylinder 6, a perforating cylinder 7, a second main cylinder 8, a rotating platform 11, and a central sliding block 12;

the first fixed beam 1 and the second fixed beam 4 are respectively located at two ends of the extrusion machine and are fixed in position; the moving beam 2 and the outer sliding block 3 are located between the first fixed beam 1 and the second fixed beam 4 and performs reciprocating rectilinear motion during operation of the extrusion machine; the moving beam 2 is arranged close to the first fixed beam 1, and the outer sliding block 3 is arranged close to the second fixed beam 4;

the guide columns 5 pass through the first fixed beam 1, the moving beam 2, the outer sliding block 3, and the second fixed beam 4 to connect them together and implement the functions of pressure bearing and guiding; the first main cylinder 6, the perforating cylinder 7 and the second main cylinder 8 are fixed to the second fixed beam 4, the perforating cylinder 7 is located on a central axis, and the first main cylinder 6 and the second main cylinder 8 are respectively located on two sides of the perforating cylinder 7 and are connected to the outer sliding block 3 to drive the outer sliding block to move; the central sliding block 12 is connected to the perforating cylinder 7; the rotating platform 11 is fixed to the first fixed beam 1, the central position of the rotating platform is located on the central axis of an apparatus, and a through hole is formed inside the rotating platform 11 for discharging;

the tool die mainly includes a rotating extrusion rod 13, an extrusion container 14, a forward extrusion rod 15, a hopper 25, a female die 27, a male die 28, and a perforating needle 29;

the rotating extrusion rod 13 is fixed to the rotating platform 11, when the rotating platform 11 is driven by a driving device to rotate, the rotating extrusion rod 13 can rotate with the rotating platform 11, and in the forming process of the extrusion machine, the rotating extrusion rod 13 only performs rotational motion and does not perform rectilinear motion;

the extrusion container 14 is fixed to the moving beam 2, and when the moving beam 2 performs rectilinear motion, the extrusion container 14 also performs rectilinear motion, that is, the extrusion container 14 performs rectilinear motion with the moving beam 2;

the forward extrusion rod 15 is fixed to the outer sliding block 3, and when the outer sliding block 3 performs rectilinear motion, the forward extrusion rod 15 also performs rectilinear motion, that is, the forward extrusion rod 15 performs rectilinear motion with the outer sliding block 3;

the hopper 25 is located above the extrusion container 14 and close to one side of the outer sliding block 3, the hopper 25 has a main function of adding a raw material into the extrusion container 14, and when the processing raw material includes chips, powder and a mixture, the raw material can be added into the extrusion container 14 through the hopper 25;

the perforating needle 29 is connected to the perforating cylinder 7, and the perforating cylinder 7 can drive the perforating needle 29 to perform rectilinear motion; and the female die 27 is fixed to the rotating extrusion rod 13, the male die 28 is fixed to the perforating needle 29, and when the perforating needle 29 moves, the male die 28 can be pressed on the female die 27, that is, the female die 27 does not perform rectilinear motion, and the male die 28 performs rectilinear motion. The material of the present disclosure performs helical motion in a gap between the male die and the female die or a working land of the female die, so that the texture type of an extruded profile can be controlled by controlling an extrusion speed, an extrusion ratio and a rotating speed, the flow line of the material is a helical flow line which is different from a straight flow line in a traditional extruded profile, and it helps to eliminate the anisotropy.

The motion driving system in the present example mainly includes a motor 9, a speed reducer 10, a hydraulic power unit 20, an electrical control cabinet 21, and a control platform 17.

The motor 9 and the speed reducer 10 are mounted on one side of the first fixed beam, the motor 9 drives the speed reducer 10, and the speed reducer 10 drives the rotating platform 11 to rotate; the hydraulic power unit 20 drives the first main cylinder 6, the perforating cylinder 7 and the second main cylinder 8 to perform reciprocating rectilinear motion; and the electrical control cabinet 21 and the control platform 17 control the speed reducer 10 and the hydraulic power unit 20.

The circulating temperature control system in the present example mainly includes a temperature measurement sensor 23, a heating element 24, a wireless transmitter 16, an oil cooler 18, and a heating and cooling control system 19.

The temperature measurement sensor 23 is located in the rotating extrusion rod 13 and the female die 27 and is close to the working land of the female die 27; the heating element 24 is located in the extrusion container 14 and is configured to heat the extrusion container; the wireless transmitter 16 is connected to the temperature measurement sensor 23 and is configured to transmit temperature measurement data to the control platform 17 in a wireless transmission form; the oil cooler 18 is configured to cool a bearing of the rotating platform 11 and the speed reducer 10; the heating and cooling control system 19 is composed of an electric control element, a cooling pump station, and a pipeline and is configured to dynamically heat and cool the extrusion container 14; and the temperature control system is integrated into the control platform 17.

A control system of the apparatus mainly includes a forward extrusion rod control module, a perforating needle control module, an extrusion container control module, a rotating extrusion rod control module, a heating element control module, a cooling element control module, and corresponding real-time display systems.

Wherein, the forward extrusion rod control module, the perforating needle control module and the extrusion container control module respectively control reciprocating rectilinear motion of the forward extrusion rod, the perforating needle and the extrusion container; the rotating extrusion rod control module is configured to control forward rotation, backward rotation and the rotating speed of the rotating platform; the heating element control module and the cooling element control module respectively control heating and cooling of the extrusion container; and the real-time display systems are configured to display and monitor related data in real time and store the data.

The helical friction extrusion forming method performed by the extrusion machine specifically includes:

S1: placing a raw material into the extrusion container 14.

If the raw material is a cylindrical blank 26, which is directly placed into the extrusion container 14 from an inlet of the extrusion container.

If the raw material is a raw material 30 such as machining chips, metal powder and a mixture, the raw material such as the chips, the powder and the mixture is first weighed and then is placed into the extrusion container 14 from the hopper 25 in batches, the moving beam 2 is moved to compress the raw material such as the chips, the powder and the mixture under the pressure of the forward extrusion rod 15, the density of a compressed blank is calculated each time of compression according to the weight of the raw material such as the chips, the powder and the mixture and the compressed volume of a compressed blank, and the density of the compressed blank is controlled to be 50% of the density of the raw material such as the chips, the powder and the mixture or higher.

S2: enabling the rotating extrusion rod 13 to rotate with a rotating speed controlled within 0.5-3000 r/min.

S3: enabling the forward extrusion rod 15 and the extrusion container 14 to synchronously get close to the rotating extrusion rod 13 to achieve helical friction extrusion forming, where in the whole extrusion process, an extrusion speed is controlled with a strategy of slow first and then fast, followed by dynamic adjustment, that is, the material in the extrusion container first slowly gets close to the rotating extrusion rod 13 which is rotating, after the material starts to be heated and softened under the friction action of the rotating extrusion rod 13, the extrusion speed is increased, and the extrusion speed is dynamically adjusted according to actual requirements; in the whole extrusion process, the extrusion speeds of the forward extrusion rod 15 and the extrusion container 14 are controlled within 0.01-50 mm/s.

In the whole extrusion process, the temperature near a working land of the die is monitored by means of the temperature measurement sensor, and the extrusion speed as well as heating and cooling of the extrusion container is adjusted dynamically to control the temperature to be 90% of the melting point of the material or below or below −100° C.;

S4: enabling the material to perform helical motion in the gap between the male die and the female die, and form an extruded material 22 after flowing out of a die port.

S5: during design of the extrusion container and an extrusion die, controlling the ratio of the cross-sectional area of the extrusion container to the cross-sectional area of the extruded material to be 1-200.

The present disclosure is explained in conjunction with specific cases below:

Example 1

Figure 4:
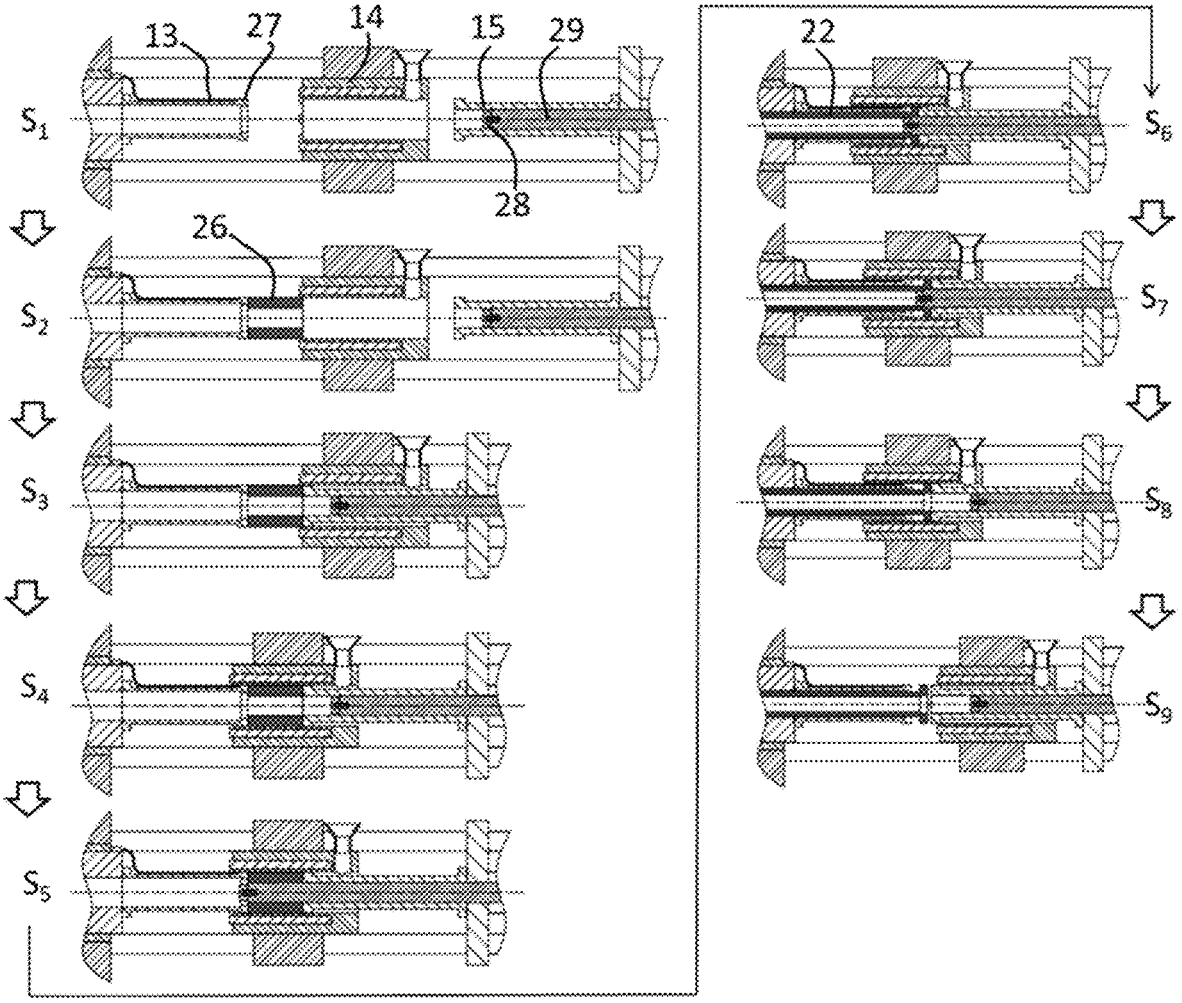
FIG. 4 is a flow diagram of a helical friction extrusion process for a bar blank.

The present example provides a helical friction extrusion forming method suitable for a bar blank. The method is used to produce a profile or pipe with a hollow section. As shown in FIG. 4, the method mainly includes the following steps:

S1: adjusting the rotating extrusion rod 13, the extrusion container 14 and the forward extrusion rod 15 to appropriate positions, thereby ensuring a sufficient loading space between the rotating extrusion rod 13 and the extrusion container 14;

S2: using a loading mechanism to place the blank 26 between the rotating extrusion rod 13 and the extrusion container 14, and enabling the blank 26 to be coaxial with the extrusion container 14;

S3: enabling the forward extrusion rod 15 and the perforating needle 29 to move forward to abut against the blank 26;

S4: enabling the extrusion container 14 to move forward, so that the blank 26 is located in a central region of the extrusion container;

S5: enabling the perforating needle 29 to move forward, so that the male die 28 is matched with the female die 27;

S6: enabling the rotating extrusion rod 13 to start to rotate, enabling the forward extrusion rod 15 and the extrusion container 14 to get close to the rotating extrusion rod 13 synchronously to achieve helical friction extrusion forming, obtaining the extruded material 22, and dynamically adjusting the extrusion speed according to the actual requirements, where in the extrusion process, the temperature near a working land of the die is monitored by means of the temperature measurement sensor, and the extrusion speed as well as heating and cooling of the extrusion container is adjusted dynamically to control the temperature to be 90% of the melting point of the material or below or below −100° C.;

S7: after the blank is shortened to a certain extent, enabling the rotating extrusion rod to continue to rotate, and enabling the forward extrusion rod 15 and the extrusion container 14 to stop moving forward and then slowly retreat, so that the rotating extrusion rod is separated from the blank;

S8: enabling the perforating needle 29 to return to the original position; and S9: enabling the extrusion container to return so as to separate the blank from the extrusion container, enabling a shearing mechanism to cut off the blank, and then repeating the above steps.

Example 2

The present example provides a helical friction extrusion forming method suitable for a bar blank. The method is used to produce a profile, bar, wire or wire rod with a solid section. The main steps of the present method are similar to those in Example 1. The differences lie in that the present method does not involve a perforating needle and corresponding actions of the perforating needle. The method includes the following specific steps:

S1: adjusting the rotating extrusion rod 13, the extrusion container 14 and the forward extrusion rod 15 to appropriate positions, thereby ensuring a sufficient loading space between the rotating extrusion rod 13 and the extrusion container 14;

S2: using a loading mechanism to place the blank 26 between the rotating extrusion rod 13 and the extrusion container 14, and enabling the blank 26 to be coaxial with the extrusion container 14;

S3: enabling the forward extrusion rod 15 to move forward to abut against the blank 26;

S4: enabling the extrusion container 14 to move forward, so that the blank 26 is located in a central region of the extrusion container;

S5: enabling the rotating extrusion rod 13 to start to rotate, enabling the forward extrusion rod 15 and the extrusion container 14 to get close to the rotating extrusion rod 13 synchronously to achieve helical friction extrusion forming to enable the material to flow out of the working land of the female die to obtain the extruded material 22, and dynamically adjusting the extrusion speed according to the actual requirements, where in the extrusion process, the temperature near a working land of the die is monitored by means of the temperature measurement sensor, and the extrusion speed as well as heating and cooling of the extrusion container is adjusted dynamically to control the temperature to be 90% of the melting point of the material or below or below −100° C.;

S6: after the blank is shortened to a certain extent, enabling the rotating extrusion rod to continue to rotate, and enabling the forward extrusion rod 15 and the extrusion container 14 to stop moving forward and then slowly retreat, so that the rotating extrusion rod is separated from the blank;

S7: enabling the extrusion container to return so as to separate the blank from the extrusion container, enabling a shearing mechanism to cut off the blank, and then repeating the above steps.

Example 3

Figure 5:
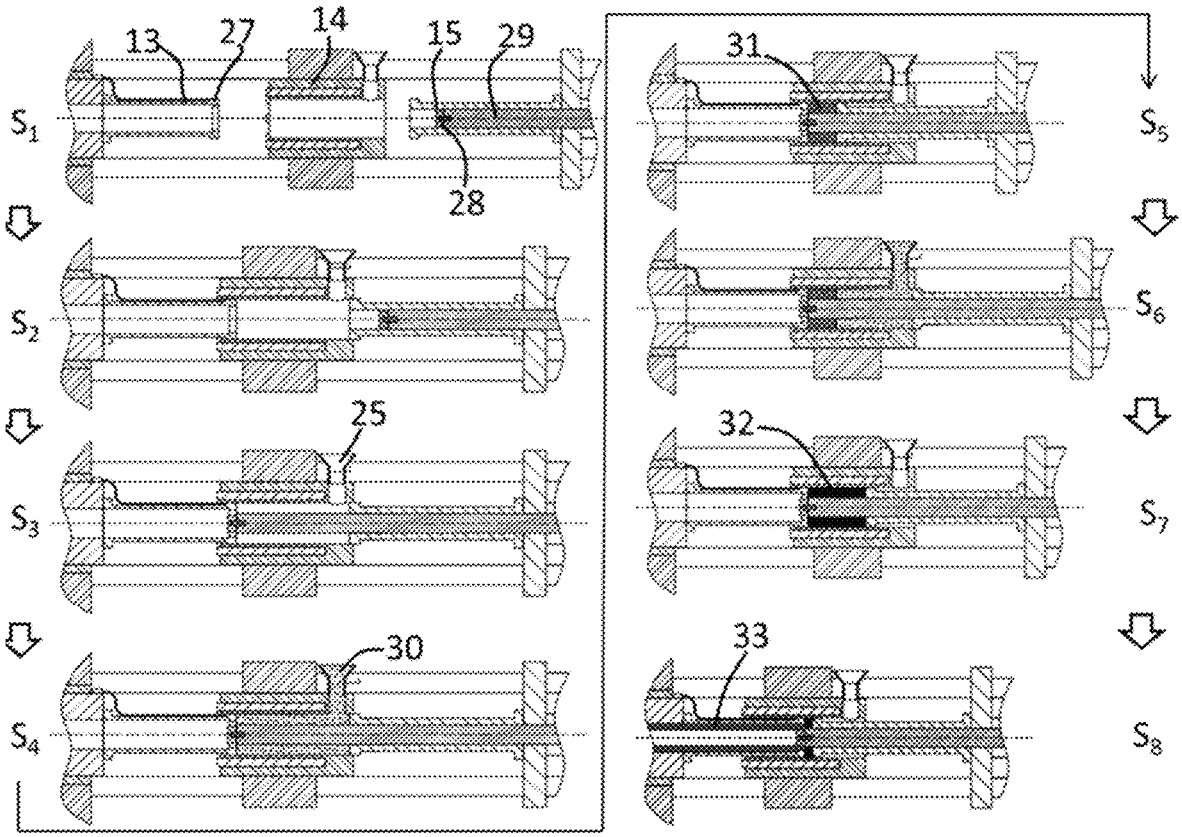
FIG. 5 is an action flow diagram for helical friction extrusion using raw materials such as chips, powder and a mixture.

The present example provides a helical friction extrusion forming method suitable for the raw material such as the chips, the powder and the mixture. The present method is used to produce a profile or pipe with a hollow section. As shown in FIG. 5, the method mainly includes the following steps:

S1: adjusting the rotating extrusion rod 13, the extrusion container 14 and the forward extrusion rod 15 to appropriate positions;

S2: enabling the rotating extrusion rod 13 and the forward extrusion rod 15 to move forward to be in contact with the extrusion container 14;

S3: enabling the perforating needle 29 to move forward, so that the male die 28 is matched with the female die 27;

S4: adding the raw material 30 such as the chips, the powder and the mixture from the hopper 25 quantitatively;

S5: enabling the forward extrusion rod 15 to move forward to compress the raw material, and calculating the density of the compressed blank 31 according to the size of an inner cavity of the extrusion container and the moving stroke of the extrusion rod;

S6: enabling the forward extrusion rod 15 to return, and repeating S4;

S7: enabling the forward extrusion rod 15 to move forward to compress the raw material, and calculating the density of the compressed blank 31 according to the size of an inner cavity of the extrusion container and the moving stroke of the extrusion rod; repeating S6 and S7 until a stacked compressed blank 32 reaches the required length and density; and controlling the density of the stacked compressed blank 32 to be 50% of the density of the raw material or higher;

S8: enabling the rotating extrusion rod 13 to start to rotate, enabling the forward extrusion rod 15 and the extrusion container 14 to get close to the rotating extrusion rod 13 synchronously to achieve helical friction extrusion forming, obtaining a regenerative extruded material 33, and dynamically adjusting the extrusion speed according to the actual requirements, where in the extrusion process, the temperature near a working land of the die is monitored by means of the temperature measurement sensor, and the extrusion speed as well as heating and cooling of the extrusion container is adjusted dynamically to control the temperature to be 90% of the melting point of the material or below or below −100° C.; and S9: after the blank is compressed to a certain length, enabling the rotating extrusion rod to continue to rotate, and enabling the forward extrusion rod 15 and the extrusion container 14 to stop moving forward and then slowly retreat, so that the rotating extrusion rod is separated from the blank; and then enabling the forward extrusion rod to return to the position described in S2, and repeating steps S4 to S8.

Example 4

The present example provides a helical friction extrusion forming method suitable for the raw material such as the chips, the powder and the mixture. The present method is used to produce a profile, bar, wire or wire rod with a solid section. The main steps of the present method are similar to those in Example 3. However, the present method does not involve a perforating needle and corresponding actions of the perforating needle. The method includes the following steps:

S1: adjusting the rotating extrusion rod 13, the extrusion container 14 and the forward extrusion rod 15 to appropriate positions;

S2: enabling the rotating extrusion rod 13 and the forward extrusion rod 15 to move forward to be in contact with the extrusion container 14; S3: adding the raw material 30 such as the chips, the powder and the mixture from the hopper 25 quantitatively;

S4: enabling the forward extrusion rod 15 to move forward to compress the raw material, and calculating the density of the compressed blank 31 according to the size of an inner cavity of the extrusion container and the moving stroke of the extrusion rod;

S5: enabling the forward extrusion rod 15 to return, and repeating S3;

S6: enabling the forward extrusion rod 15 to move forward to compress the raw material, and calculating the density of the compressed blank 31 according to the size of an inner cavity of the extrusion container and the moving stroke of the extrusion rod; repeating S5 and S6 until a stacked compressed blank 32 reaches the required length and density; and controlling the density of the stacked compressed blank 32 to be 50% of the density of the raw material or higher;

S7: enabling the rotating extrusion rod 13 to start to rotate, enabling the forward extrusion rod 15 and the extrusion container 14 to get close to the rotating extrusion rod 13 synchronously to achieve helical friction extrusion forming to enable the material to flow out of the working land of the female die to obtain a regenerative extruded material 33, and dynamically adjusting the extrusion speed according to the actual requirements, where in the extrusion process, the temperature near a working land of the die is monitored by means of the temperature measurement sensor, and the extrusion speed as well as heating and cooling of the extrusion container is adjusted dynamically to control the temperature to be 90% of the melting point of the material or below or below −100° C.; and S8: after the blank is compressed to a certain length, enabling the rotating extrusion rod to continue to rotate, and enabling the forward extrusion rod 15 and the extrusion container 14 to stop moving forward and then slowly retreat, so that the rotating extrusion rod is separated from the blank; and then enabling the forward extrusion rod to return to the position described in the S2, and repeating steps S3 to S7.

In the above examples, the control ranges of the extrusion process parameters are as follows.

Furthermore, to weaken the anisotropy, generate severe shear deformation, and promote chips consolidation, oxide breakage and interface bonding, in Examples 1-4, the rotating speed of the rotating extrusion rod is controlled within 0.5-3000 r/min; the extrusion speeds of the forward extrusion rod 15 and the extrusion container 14 are controlled in the range of 0.01-50 mm/s; the ratio of the cross-sectional area of the extrusion container to the cross-sectional area of the extruded material is controlled to be 1-200; and the extrusion speed as well as heating and cooling of the extrusion container is adjusted dynamically to control the temperature near the working land of the die to be within 90% of the melting point of the material.

Furthermore, when a nanoscale twin component is prepared, the rotating speed of the rotating extrusion rod is controlled within 0.5-1000 r/min; the extrusion speeds of the forward extrusion rod 15 and the extrusion container 14 are controlled in the range of 0.01-50 mm/s; the ratio of the cross-sectional area of the extrusion container to the cross-sectional area of the extruded material is controlled to be 1-200; and the temperature near the working land of the die is controlled below −100° C.

The material in the examples undergoes severe shear deformation in the whole forming process, which is beneficial to grain refinement (even formation of nanoscale twins), chips consolidation, oxide breakage, and interface bonding, so that the performance of the extruded material is greatly improved.

The helical friction extrusion machine of the special design in the examples solves the problems about loading, feeding, compressing, and perforating, and the apparatus is suitable for industrial large-scale production; and the apparatus can be used for forming and preparing various profiles with solid or hollow sections and unlimited length directions, such as bars, wires, pipes and profiled bars, and the profiles obtained through chips forming can be used without downgrading.

The raw material in the present disclosure does not need to be heated, the heating element is arranged in the extrusion container, the procedure of heating the bar in a traditional hot extrusion process is cancelled, the energy generated under the friction action in the extrusion process is fully utilized, and the energy consumption is effectively reduced.

The invention claimed is:

1. A helical friction extrusion machine, comprising a main machine and a tool die, wherein the main machine comprises a first fixed beam, a moving beam, an outer sliding block, a second fixed beam, guide columns, a first main cylinder, a perforating cylinder, a second main cylinder, a rotating platform, and a central sliding block; the first fixed beam and the second fixed beam are respectively located at two ends of the extrusion machine and are fixed in position; the moving beam and the outer sliding block are located between the first fixed beam and the second fixed beam and performs reciprocating rectilinear motion during operation of the extrusion machine; the moving beam is arranged adjacent to the first fixed beam, and the outer sliding block is arranged adjacent to the second fixed beam; the guide columns pass through the first fixed beam, the moving beam, the outer sliding block, and the second fixed beam; the first main cylinder, the perforating cylinder and the second main cylinder are fixed to the second fixed beam, the perforating cylinder is located on a central axis, and the first main cylinder and the second main cylinder are respectively located on two sides of the perforating cylinder and are connected to the outer sliding block to drive the outer sliding block to move; the central sliding block is connected to the perforating cylinder; the rotating platform is fixed to the first fixed beam, the central position of the rotating platform is located on the central axis of the helical friction extrusion machine, and a through hole is formed inside the rotating platform for an extruded material;

the tool die comprises a rotating extrusion rod, an extrusion container, a forward extrusion rod, a hopper, a female die, a male die, and a perforating needle; the rotating extrusion rod is fixed to the rotating platform; the extrusion container is fixed to the moving beam; the forward extrusion rod is fixed to the outer sliding block; the hopper is located above the extrusion container and adjacent to one side of the outer sliding block; the perforating needle is connected to the perforating cylinder; the female die is fixed to the rotating extrusion rod; and the male die is fixed to the perforating needle.

2. The helical friction extrusion machine according to claim 1, further comprising a motion driving system, which comprises a rotating platform driving device, a driving device for the first main cylinder, the perforating cylinder and the second main cylinder, and a motion control platform; and the rotating platform driving device and the driving device for the first main cylinder, the perforating cylinder and the second main cylinder are connected to the motion control platform.

3. The helical friction extrusion machine according to claim 1, further comprising a circulating temperature control system, which comprises a temperature measurement sensor, a heating element, a cooling element, and a temperature control platform; a temperature measurement sensor is arranged in the rotating extrusion rod and the female die, the temperature measurement sensor is connected to a wireless transmitter; wherein the temperature measurement data is transmitted to the temperature control platform in a wireless transmission form; the heating element and the cooling element are arranged in the extrusion container for heating the extrusion container; and the temperature measurement sensor, the heating element and the cooling element are connected to a control platform.

4. The helical friction extrusion machine according to claim 3, wherein the circulating temperature control system further comprises an oil cooler, and the oil cooler is configured to cool a bearing of the rotating platform and a speed reducer; and the hopper is further arranged on the extrusion container.

5. The helical friction extrusion machine according to claim 1, further comprising a control system, which comprises a forward extrusion rod control module, a perforating needle control module, an extrusion container control module, a rotating extrusion rod control module, a heating element control module, a cooling element control module, and corresponding real-time display systems.

6. A forming method using the helical friction extrusion machine according to claim 1, comprising:

Step 1: placing a raw material into the extrusion container;

wherein, when the raw material is a cylindrical blank it is directly placed into the extrusion container from an inlet of the extrusion container;

Step 2: enabling the rotating extrusion rod to rotate;

Step 3: enabling the forward extrusion rod and the extrusion container to get adjacent to the rotating extrusion rod synchronously to achieve helical friction extrusion forming;

wherein, throughout an entire extrusion process of the forming method, an extrusion speed is controlled with a strategy of slow first and then fast, followed by dynamic adjustment; and Step 4: enabling the material to perform helical motion in a gap between the male die and the female die, and become the extruded material after flowing out of a die port.

7. The forming method according to claim 6, wherein in step 1, when the raw material is a mixture comprising machining chips and metal powder, the raw material is first weighed and then is placed into the extrusion container from the hopper in batches, the moving beam is moved to compress the chips and the powder under pressure of the forward extrusion rod, a density of a compressed blank is calculated for each compression movement of the forward extrusion rod according to the weight of the chips and the powder and a compressed volume thereof, and the density of the compressed blank is controlled to be 50% of a density of the raw material or higher.

8. The forming method according to claim 6, wherein throughout the entire extrusion process of the forming method, a temperature near a working land of the die is monitored by the temperature measurement sensor, and the extrusion speed as well as heating and cooling of the extrusion container is adjusted dynamically to control the temperature to be 90% of a melting point of the material or below −100° C.

9. The forming method according to claim 6, wherein a rotating speed of the rotating extrusion rod is controlled to be 0.5-3000 r/min; and the extrusion speed of the forward extrusion rod and the extrusion container is controlled in a range of 0.01-50 mm/s.

10. The forming method according to claim 7, wherein a ratio of a cross-sectional area of the extrusion container to a cross-sectional area of the extruded material is controlled to be 1-200.

* * * * *